United States Patent [19]

Rosenberg

[11] 4,049,510

[45] Sept. 20, 1977

[54] BATHS AND ADDITIVES FOR THE ELECTRODEPOSITION OF BRIGHT ZINC

[75] Inventor: William E. Rosenberg, Strongsville, Ohio

[73] Assignee: Columbia Chemical Corporation, Cleveland, Ohio

[21] Appl. No.: 735,420

[22] Filed: Oct. 26, 1976

Related U.S. Application Data

[63] Continuation-in-part of Ser. No. 593,310, July 7, 1975, Pat. No. 3,988,219, and Ser. No. 610,251, Sept. 4, 1975, Pat. No. 4,007,098.

[51] Int. Cl.[2] ..... C25D 3/22

[52] U.S. Cl. ..... 204/55 R; 204/DIG. 2

[58] Field of Search ..... 204/55 R, 55 Y, DIG. 2, 204/114, 43 Z, 44

[56] References Cited

U.S. PATENT DOCUMENTS

| | | | |
|---|---|---|---|
| 3,729,394 | 4/1973 | Hsu et al. | 204/55 R |
| 3,928,149 | 12/1975 | Steeg | 204/55 R |
| 3,988,219 | 10/1976 | Rosenberg | 204/55 R |
| 4,007,098 | 2/1977 | Rosenberg | 204/55 R |

*Primary Examiner*—G. L. Kaplan

*Attorney, Agent, or Firm*—Oldham & Oldham Co.

[57] ABSTRACT

A zinc brightener additive comprises a polymeric amine selected from the class consisting of a linear aliphatic amine polymer, an aminated polyepichlorohydrin, a polyethylenimine, and combinations thereof, and a propylene oxide-ethylene oxide block copolymer prepared by the sequential addition of propylene oxide followed by ethylene oxide, or vice versa, to a residue of an organic compound containing active hydrogen atoms such as propylene glycol or an amine base. Additionally, an aqueous acid electroplating bath containing the polymeric amine compound in combination with the propylene oxide-ethylene oxide and block copolymer provides bright, lustrous electrodepositions of zinc. Moreover, aromatic aldehydes and ketones may be utilized to provide extremely bright electrodepositions of zinc.

35 Claims, No Drawings

BATHS AND ADDITIVES FOR THE ELECTRODEPOSITION OF BRIGHT ZINC

CROSS-REFERENCE

This application is a continuation-in-part of both U.S. Pat. application Ser. No. 593,310, filed July 7, 1975, now U.S. Pat. No. 3,988,219, and U.S. Pat. application Ser. No. 610,251, filed Sept. 4, 1975, now U.S. Pat. No. 4,007,098.

BACKGROUND OF THE INVENTION

The present invention relates to a zinc electroplating bath brightener and to improvements in the electrodeposition of zinc from aqueous acid plating baths containing the zinc brightener.

Heretofore, certain characteristics of conventionally utilized acid zinc bath formulations have rendered them in many instances somewhat impractical to use. For example, the bath formulations disclosed in U.S. Pat. No. 3,694,330, has a limiting factor in that only a rather low current density can be applied to a given article to produce a lustrous zinc deposit. Should the current density be raised to increase the speed of plating, very dark, coarse deposits of zinc would be plated on the article. Another common problem is that which occurs in using the bath formulations of U.S. Pat. No. 3,723,263 in that at bath temperatures of above 95° F, the formulations encounter a severe loss of brightening ability.

Another prior art U.S. Pat. No. 3,723,263 and a division thereof, U.S. Pat. No. 3,767,540, both relate to aqueous acid zinc electroplating baths containing naphthol polyoxyalkylate in combination with polyethylenimine. These patents also state that aromatic aldehydes and ketones may be present. U.S. Pat. No. 3,729,394 relates to an acid zinc electroplating bath having dissolved therein a block copolymer of propylene oxide and ethylene oxide. The block copolymer may be utilized alone or in instances with a compound of N-(alkyl sulfonyl) glycine. Additionally, another U.S. Pat., namely U.S. Pat. No. 2,674,619, relates to polyoxyalkylene compounds which have an outstanding detergent and surface active properties and in which the hydrophobic element is a polyoxypropylene polymer having a molecular weight of at least 900.

The present invention relates to a zinc brightener which is not taught or suggested by the above prior art patents and moreover, the present invention produces a synergistic result in that extremely bright and lustrous deposits of zinc are obtained.

SUMMARY OF THE INVENTION

Accordingly, it is an object of the present invention to provide brightening agents which produce extremely bright electrodeposits of zinc when utilized in a plating bath.

It is another object of the present invention to produce bright deposits of zinc, as above, utilizing a zinc brightener compound comprising a polymeric amine selected from the class consisting of a linear aliphatic amine, an aminated polyepichlorohydrin, a polyethylenimine, and combinations thereof, and a propylene oxide-ethylene oxide block copolymer.

It is an additional object of the present invention to produce bright deposits of zinc utilizing a brightening agent, as above, wherein the linear aliphatic amine polymer is prepared by a reaction from about 50 percent to about 200 percent of a stoichiometric amount of an epihalohydrin selected from the class consisting of epichlorohydrin and epibromohydrin with a linear aliphatic polyamine selected from the class consisting of a compound having at least two primary amine groups, two secondary amine groups, or one primary and one secondary amine group, separated by two through six methylene groups or alkyl substituted methylene groups.

It is a further object of the present invention to produce bright deposits of zinc utilizing a brightening agent, as above, wherein the aminated polyepichlorohydrin is prepared by reacting polyepichlorohydrin with an amine selected from the class consisting of secondary aliphatic amines and secondary alicyclic amines with the amount of said amines being such that between 50 percent to 100 percent of the chloro groups in said polyepichlorohydrin is reacted.

It is yet another object of the present invention to provide bright deposits of zinc utilizing a brightening agent, as above, wherein the polyethylenimine has the formula:

$$\left(\overset{\overset{\displaystyle R}{|}}{N}-CH_2-CH_2\right)_y$$

wherein R is hydrogen, methyl, ethyl, propyl, isopropyl, hydroxyethyl, 2-hydroxypropyl, 3-hydroxypropyl, 2-aminoethyl, 2-aminopropyl, 3-aminopropyl, and $y$ is from about 10 to about 100.

It is yet a further object of the present invention to produce bright deposits of zinc utilizing a brightening agent, as above, wherein said block copolymer of ethylene oxide and propylene oxide is prepared by the sequential addition of propylene oxide followed by ethylene oxide, or vice versa, upon the residue of any organic compound containing a plurality of hydrogen atoms such as propylene glycol or an amine base.

It is yet another object of the present invention to produce bright deposits of zinc utilizing a brightening agent, as above, wherein the brightening agent includes aromatic aldehydes and aromatic ketones.

It is yet another object of the present invention to produce bright deposits of zinc utilizing a brightening agent, as above, in an aqueous acid zinc electroplating bath which contains a source of zinc ions, ammonium chloride and nonionic, cationic, anionic, and amphoteric wetting agents.

It is yet another object of the present invention to produce bright deposits of zinc utilizing a brightening agent, as above, in an aqueous acid zinc electroplating bath which contains zinc ions, potassium chloride and/or sodium chloride and can further contain a complexing agent such as ethylene diamine.

In general, a zinc brightener additive comprises, from about 1 percent to about 99 percent by weight of a polymeric amine selected from the class consisting of, a linear aliphatic amine polymer prepared by reacting from about 50 percent to about 200 percent of a stoichiometric amount of an epihalohydrin selected from the class consisting of epichlorohydrin and epibromohydrin with a linear alihatic polyamine selected from the class consisting of a compound having at least two primary amine groups, two secondary amine groups, or one primary and one secondary amine group; said amine groups separated by two through six methylene groups or alkyl substituted methylene groups;

an aminated polyepichlorohydrin prepared by reacting polyepichlorohydrin with an amine selected from the group consisting of secondary aliphatic amines and secondary alicyclic amines at a temperature of from about 110° C to about 170° C; the amount of said amines is such so that between 50 percent to 100 percent of the chloro groups in said polyepichlorohydrin is reacted;

a polyethylenimine having the formula:

$$\left(\overset{R}{\overset{|}{N}}-CH_2-CH_2\right)_y$$

where R is hydrogen, methyl, ethyl, propyl, isopropyl, hydroxyethyl, 2-hydroxypropyl, 3-hydroxypropyl, 2-aminoethyl, 2-aminopropyl, and 3-aminopropyl, and $y$ is about 10 to about 100, and combinations thereof;

including from about 1 to about 99 percent by weight of a propylene oxide-ethylene oxide block copolymer having a molecular weight of more than 500; and said block copolymer prepared by the sequential addition of propylene oxide and ethylene oxide in either order to a residue or any organic compound containing a plurality of active hydrogen atoms.

Generally, the invention relates to an aqueous acid zinc electroplating bath for producing a bright electrodeposition of zinc containing zinc ions, comprising, having dissolved therein from about 0.5 to about 10.0 grams/liter of a polymeric amine selected from the class consisting of a linear aliphatic amine polymer prepared by reacting from about 50 percent to about 200 percent of a stoichiometric amount of an epihalohydrin selected from the class consisting of epichlorohydrin and epibromohydrin with a linear aliphatic polyamine selected from the class consisting of a compound having at least two primary amine groups, two secondary amine groups, or one primary and one secondary amine group; said amine groups separated by two through six methylene groups or alkyl substituted methylene groups;

an aminated polyepichlorohydrin prepared by reacting polyepichlorohydrin with an amine selected from the group consisting of secondary aliphatic amines and secondary alicyclic amines at a temperature of from about 110° C to about 170° C, the amount of said amines is such so that between 50 percent to 100 percent of the chloro groups in said polyepichlorohydrin is reacted, a polyethylenimine having the formula:

$$\left(\overset{R}{\overset{|}{N}}-CH_2-CH_2\right)_y$$

where R is hydrogen, methyl, ethyl, propyl, isopropyl, hydroxyethyl, 2-hydroxypropyl, 3-hydroxypropyl, 2-aminoethyl, 2-aminopropyl, and 3aminopropyl, and $y$ is about 10 to about 100, and combinations thereof, and including from 1 to about 10 grams/liter of a propylene oxide-ethylene oxide block copolymer having a moleculer weight of more than 500;

said block copolymer prepared by the sequential addition of propylene oxide and ethylene oxide, in either order, to a residue of any organic compound containing a plurality of active hydrogen atoms.

DESCRIPTION OF THE PREFERRED EMBODIMENTS

According to the concepts of the present invention, it has been found that propylene oxide-ethylene oxide block copolymers when combined with a polymeric amine selected from the class consisting of a linear aliphatic amine, an aminated polyepichlorohydrin, a polyethylenimine, and combinations thereof, form very effective zinc brighteners which may be utilized in aqueous acid zinc electroplating baths. Additionally, the ammonium chloride generally utilized in such zinc plating baths may be substituted by the use of potassium chloride and/or sodium chloride and furthermore may incorporate a small amount of a complexing agent such as ethylene diamine. The composition is truly synergistic in that the result obtained with the combination far exceeds the result obtained by using the compounds alone or any additive result of either compound.

Considering the aminated polyepichlorohydrin polymers, they, of course, have various molecular weights and are currently available in commerce and the technology for their preparation is extensively devulged in numerous papers and articles found in the chemical literature. A very wide range of molecular weights of polyepichlorohydrin is acceptable for use in this invention such as from 1,000 to about 20,000, and the preferred molecular weight range is from about 1,000 to about 5,000.

Amination of polyepichlorohydrin to obtain a tertiary amine can be accomplished by carefully heating approximate stoichiometric quantities, that is from about a ratio of about 1.0 to about 2.0 of a secondary amine such as a secondary aliphatic amine or a secondary alicyclic amine preferably having from 2 to about 6 carbon atoms, and polyepichlorohydrin at temperatures ranging from about 110° to about 170° C and preferably from about 120° C to 150° C for at least one hour to about eight hours with good stirring. Therefore, the amount of the amine is regulated on a molar basis so that between 50 percent and 100 percent of the chloro groups in the polyepichlorohydrin is reacted. Thus, if the stoichiometric amount of the polyepichlorohydrin is about 1.0, than about 100 percent of the chloro groups will be reacted, whereas if the stoichiometric amount of the polyepichlorohydrin to the amine is about 2.0, then only about 50 percent of the chloro groups and the polyepichlorohydrin will be reacted. In the case where a highly volatile amine is used, the reaction desirably is carried out in a suitable vessel under pressure in order to obtain the required temperatures and avoid losing a low boiling reactant. More specifically, the amination of polyepichlorohydrin can be prepared according to methods set forth in U.S. Pat. No. 3,824,158 as in Examples I and II thereof, which patent is hereby fully incorporated by reference, particularly with respect to the said method of preparation, formulation, structure, and the like.

Listed in Table I are specific examples of secondary aliphatic and alicyclic amines which may be utilized to form the aminated polyepichlorohydrins.

TABLE I

1. Dimethylamine
2. Diethylamine
3. Dipropylamine
4. Diisopropylamine
5. Methylethylamine
6. Methyl propylamine
7. Methyl isopropylamine
8. Ethyl isopropylamine
9. N-methyl ethanolamine
10. N-methyl propanolamine
11. N-methyl isopropanolamine
12. N-ethyl propanolamine
13. N-ethyl isopropanolamine
14. N-propyl propanolamine
15. N-propyl isopropanolamine TABLE I-continued

| | |
|---|---|
| 16. | N-isopropyl isopropanolamine |
| 17. | Diethanolamine |
| 18. | Dipropanolamine |
| 19. | Diisopropanolamine |
| 20. | Morpholine |
| 21. | Piperidine |

The aminated polyepichlorohydrin compounds of this invention are used at a concentration of about 0.5 to 10 grams/liter of plating bath and the preferred amount is about 5 grams/liter. They are generally added as aqueous solutions for convenience in handling. Additionally, methanol, ethanol and ispropanol may be utilized. Still further, solvents such as a glycol, for example, ethylene glycol, and various glycol ethers can be utilized.

The ethylene oxide condensation products which may be utilized as set forth in my copending application, U.S. Ser. No. 593,310, now U.S. Pat. No. 3,988,219, are readily available in commerce. They are used at a concentration of about 1 to about 10 grams/liter of bath and the preferred amount is about 5 grams/liter. They are prepared by condensing at least six moles and up to about 30 moles of ethylene oxide per mole of long chain fatty alcohol, long chain fatty acid, long chain fatty amine, long chain alkyl phenol, or naphthol. Long chain is defined here as an aliphatic chain of at least 6 carbon atoms and up to about 30 carbon atoms. Preferably from 6 carbon atoms to 20 carbon atoms are utilized. Of the two naphthols that are possible, the beta naphthol is the preferred choice. Of course, many long chain groups exist such as lauryl, stearyl, nonyl and the like. Additional groups or compounds are well within the knowledge of one skilled in the art.

Of course, the present invention does not relate to the use of ethylene oxide condensation products. Rather, the present invention relates to the composition of the aminated polyepichlorohydrin with block copolymers of propylene oxide and ethylene oxide.

The linear aliphatic polymeric amines of the present invention are prepared by the reaction of about 50 percent to about 200 percent of a stoichiometric amount of an epihalohydrin selected from the group consisting of epichlorohydrin and epibromohydrin, and a linear aliphatic polyamine selected from the class consisting of a compound containing at least two primary amine groups, two secondary amine groups, or one primary and one secondary amine group, the amine groups separated by two through six, preferably two or three, methylene groups or alkyl substituted methylene groups.

While the choice of a linear aliphatic polyamine is quite large, specific preferred examples include the compounds set forth in Table II.

TABLE II

| | |
|---|---|
| 1. | Ethylene diamine |
| 2. | Propylene diamine |
| 3. | Diethylene triamine |
| 4. | Triethylene tetramine |
| 5. | Tetraethylene pentamine |
| 6. | Pentaethylene hexamine |
| 7. | N-(2-aminoethyl)1,3-propanediamine |

The reaction to form the linear aliphatic amine polymer of the present invention is carried out in a suitable vessel equipped with a reflux condenser. In general, the temperature of the addition of the epihalohydrin and the reflux step is from about 110° F to about 220° F with the addition temperature being at the lower end of this range and the reflux step being at the higher end of this range. The invention will be better understood by reference to the following examples.

EXAMPLE I

Add 206 grams of diethylene triamine to a reaction flask. Next, add 910 ml. of water. While mixing slowing, add 185 grams of epichlorohydrin, adding at such a rate that the exothermic reaction desirably does not raise the solution temperature over 130° F. Some cooling may be necessary. After all the epichlorohydrin has been added, the solution is heated to reflux at 215° F and held at that temperature for two hours. The solution is then allowed to cool and is used as an additive or portion of an additive without necessity for further dilution.

EXAMPLE II

Add 378 grams of tetraethylene pentamine to a reaction flask. Next, add 1320 ml. of water. While mixing slowly, add 185 grams of epichlorohydrin, adding at such a rate that the reaction does not raise the solution temperature over 160° F. After all the epichlorohydrin is added, the solution is heated and refluxed for two hours at a temperature of about 215° F. Upon cooling, the solution is used without necessity for further dilution as an additive for bright zinc plating.

EXAMPLE III

Add 292 grams of triethylene tetramine to a reaction flask. Next, add 1500 ml. of water. While mixing slowly, add 274 grams of epibromohydrin, adding at such a rate that the temperature of the solution does not rise above 160° F. When all the epibromohydrin is added, heat the solution and reflux for three hours at a temperature of 215° F. Upon cooling, the solution is used on an as is basis as a zinc plating additive.

Amounts of epihalohydrin higher than about 1.25 of an equal molar amount of amine may be used, but cross-linking will occur and the reaction product may have only limited solubility in an aqueous acid zinc electroplating bath. Since the cross-linking involves branching of epihalohydrin groups and pendant amines are not formed, no low current-density darkening upon extending electrolysis is observed. Amounts of epihalohydrin lower than about 0.75 of an equal molar amount of amine may be used, but this creates comparatively short chain polymers as a result. Polymers of rather short chain lengths require higher concentrations in the plating bath than longer chain polymers to produce the same degree of beneficial effect. In no case will the unreacted amine produce satisfactory results in place of the epihalohydrin-polyamine reaction product of this invention. Since the chain lengths are very short, extremely high concentrations are required in the plating bath to provide brightness over a wide current-density range. When these amines are used in such high concentrations, they produce even more severely dark electrodeposits in the low current-density areas than are obtained when using a polyethylenimine discussed below or an aminated polyepichlorohydrin discussed above. Thus, a preferred ratio of epihalohydrin to polyamine is from about 0.75 to about 1.25.

The linear aliphatic amine polymers of this invention are used at a concentration of about 0.5 to about 10 grams/liter of plating bath and the preferred amount is about 2 grams/liter. They are generally added as aqueous solutions for convenience in handling. Additionally, solvents such as methanol, ethanol, and isopropanol may be utilized along with glycols, for example, ethylene glycol and various glycol ethers.

The linear aliphatic amine polymer produced by the reaction of the polyamine compound and the epihalohydrin compound results in generally an alternating structure which contains repeating units. For example, the reaction between ethylene diamine and epichlorohydrin gives the following formula:

$$Y\text{-}[CH_2CHOHCH_2NH\text{-}(CH_2CH_2NH)\text{-}]_nY$$

where Y is hydrogen, hydroxy, chloro, or $\text{-}(CH_2CH_2NH)\text{-}_xH$, $x$ is 1 and $n$ is about 5 to about 200. Reactions of other compounds will result in a similar structure generally containing an alternating unit of the epihalohydrin and the linear aliphatic polyamine. Similarly, the number of repeating units will generally vary from about 5 to about 200 and hence the molecular weight of the particular polymer will vary accordingly. Generally, the number of repeating units is usually small and such a fact is well known to those skilled in the art. That is, the number of repeating units will usually vary from about 5 to about 50. If a compound other than ethylene diamine is used, $x$ is an integer which can vary up to 5, inclusive.

In my copending U.S. patent application Ser. No. 610,251, now U.S. Pat. No. 4,007,098, the linear aliphatic amine polymer was utilized in a composition with an ethylene oxide condensation product to result in extremely bright electrodeposits of zinc over a broad plating range and especially at low current densities as well as at relatively high bath temperatures. In contrast, it was noted that the utilization of the ethylene oxide condensation products with an aminated polyepichlorohydrin, as described above, or with a polyethylenimine, as described below, does not produce similar results due evidently to the fact that the aminated polyepichlorohydrin as well as the polyethylenimine polymers had branched or pendant amine groups as opposed to the linear aliphatic polymeric amine.

In any event, the ethylene oxide condensation product utilized was readily available in commerce. Additionally, they were generally used at a concentration of about 1 to about 10 grams/liter of bath and the preferred amount is about 5 grams/liter. In combination with the linear aliphatic amine polymers as an additive, the weight percent of the ethylene oxide condensate may range from about 1 to about 99 and hence the weight percent of the linear aliphatic amine polymer will range from about 1 to about 99 percent. They are prepared by condensing at least six moles and up to about 30 moles of ethylene oxide per mole of long chain fatty alcohol, long chain fatty acid, long chain fatty amine, long chain alkyl phenol, or naphthol. Long chain is defined here as an aliphatic chain of at least 6 carbon atoms and up to about 30 carbon atoms. Preferably from 6 carbon atoms to 20 carbon atoms are utilized. Of the two naphthols that are possible, the beta naphthol is the preferred choice. Of course, many long chain groups exist such as lauryl, stearyl, nonyl and the like. Additional groups or compounds are well within the knowledge of one skilled in the art.

The present invention does not relate to the combination of the linear aliphatic amine polymers with ethylene oxide condensation products as set forth in my copending application, Ser. No. 610,251, now U.S. Pat. No. 4,007,098, but rather, as previously noted, it relates to the combination of the linear aliphatic amine polymers with the ethylene oxide-propylene oxide block copolymers.

Considering now the polymer of the polyethylenimine, the formula of the repeating structure is as follows:

$$\text{-}(N(R)\text{-}CH_2\text{-}CH_2)\text{-}_y$$

where R is hydrogen, methyl, ethyl, propyl, isopropyl, hydroxyethyl, 2-hydroxypropyl, 3-hydroxypropyl, 2-aminoethyl, 2-aminopropyl, and 3-aminopropyl, where $y$ is from about 10 to about 100 and desirably from 10 to about 20. The polyethylenimine polymer is generally readily available in commerce and can be readily purchased or if desired, formulated according to methods or processes well known to those skilled in the art. The preparation of the polyethylenimine is not within the scope of the present invention. U.S. Pat. Nos. 3,723,263 and 3,767,540 which relate to the utilization of polyethylenimines in acid zinc plating baths are hereby fully incorporated by reference with regard to the use as an additive in zinc plating baths. Generally, the amount of the polyethylenimine utilized in a bath ranges from about 0.5 to about 10 grams/liter. The polyethylenimine can be added as an aqueous solution. Additionally, aliphatic alcohols such as methane, ethanol, isopropanol may be utilized along with glycols, for example, ethylene glycol and various glycol ethers.

The amount of solvent is usually not critical and may vary over a very wide range for not only the additive, but also the bath, as well known to those skilled in the art.

According to the present invention, it has been found that when a polymeric amine such as either a linear aliphatic amine, an aminated polyepichlorohydrin compound, a polyethylenimine compound, as described above, or any combinations thereof, when combined with a block copolymer of propylene oxide-ethylene oxide, give very bright or extremely bright electrodepositions of zinc in a plating bath which exceed the additive effect of any combination. The propylene oxide-ethylene oxide block copolymers are commercially available and may be prepared by methods or processes well known to those skilled in the art as by the sequential addition of propylene oxide to a residue of any organic compound containing a plurality of active hydrogen atoms followed by the sequential addition of ethylene oxide. That is, a polyoxypropylene polymer is formed on the residual base with an ethylene oxide block polymer then being formed thereon. Alternatively, the ethylene oxide may be added first to the residual base to form a polyoxyethylene polymer with the propylene oxide monomers then being added to form the block copolymer. In any event, it is desirable that the molecular weight of the block copolymer be greater than 500 and up to about 15,000 with a preferred molecular weight range being greater than 900 and up to about 15,000. Desirably, the residue base is ethylene glycol, propylene glycol or an amine compound as set forth below in Table III. The polyoxyethylene portion can vary from about 30 percent to about 90 percent of the block copolymer. Hence, the polyoxypropylene portion of the block copolymer can range from about 10 percent to about 70 percent. The amount of the block copolymer in a plating bath will vary from 1.0 to about 10 grams/liter, with about 2 to about 8 grams/liter being preferred.

The preparation and structure of the block copolymer is set forth in U.S. Pat. No. 2,674,619, which is hereby fully incorporated by reference with regard to the structure, mode of preparation, and all other features pertinent to the block copolymer. The amines which may be utilized as a residue must contain at least one reactive hydrogen and must be a secondary or primary amine. Examples of suitable amines are set forth in Table III.

TABLE III

| | |
|---|---|
| Methylamine | Dipropylamine |
| Ethylamine | Dipropanolamine |
| Propylamine | Diisopropanolamine |
| Ethylene diamine | Isopropylamine |
| Propylene diamine | Diisopropylamine |
| Ethanolamine | Diethylene triamine |
| Diethanolamine | Triethylene tetramine |
| Dimethylamine | Tetraethylene pentamine |
| Diethylamine | Pentaethylene hexamine |

The amount of the propylene oxide-ethylene oxide block copolymer in combination with any of the polymeric amine compounds will range from about 1 percent to about 99 percent by weight to form a zinc brightener which may be utilized in a zinc plating bath. A more preferred range extends from about 5 percent to about 40 percent by weight. Hence, the amount of the polymeric amine compounds may range from 1 percent to 99 percent by weight. As noted, the concentration of the polymeric amine compounds will range from about 0.5 grams to about 10.0 grams/liter in a zinc plating bath.

It is often desirable to utilize aromatic aldehydes and/or aromatic ketones along with the zinc brightener of the present invention to further enhance the plating results. Table IV lists some specific preferred aldehydes and ketones. Concentrations of from about 0.05 to about 0.5 grams/liter of plating bath may be used with the preferred amount being approximately 0.1 grams/liter. Benzylidene acetone has been found to give the best results and is therefore highly preferred. The polymeric amines, the propylene oxide-ethylene oxide block copolymers and the aromatic aldehydes or aromatic ketones can be added separately or any combination of two, or all three together.

TABLE IV

1. Benzylidene acetone
2. Vanillan
3. Heliotropin
4. Anisaldehyde
5. Veratraldehyde
6. Acetophenone
7. 1-acetonaphthone
8. 2-acetonaphthone
9. Cinnamic aldehyde
10. 2-chlorobenzaldehyde
11. 2,6-dichlorobenzaldehyde The aldehydes and ketones can be added in concentrated form but are more conveniently added in a suitable solvent such as methanol or ethanol. When utilized in combination with the polymeric amines of the present invention as well as the propylene oxide-ethylene oxide block coploymers, the weight percent of the aldehyde and/or ketone may range from about 1 to about 20 percent.

Generally, the source of zinc ions may be from any zinc salt such as zinc sulfate, zinc acetate, etc., with zinc chloride being preferred. A suitable concentration of zinc ions is from about 7.5 to about 40 grams/liter. Additionally, a pH range of about 4.0 to about 6.5 is desired for good plating results. Of course, the presence of ammonium chloride is highly preferred and a desirable range is from about 100 to about 300 grams/liter.

Nonionic, cationic, anionic, and amphoteric wetting agents can be added both to the additive as well as to the plating bath to solubilize the other additives and also to prevent gas streaking of the electrodeposit. The wetting agents are used at a concentration of about 1 to 10 grams/liter in the bath and from about 1 to 80 percent by weight of the combination of the polymeric amine, the block copolymer and any aldehyde or ketone. Table V lists some of the preferred wetting agents.

TABLE V

| WETTING AGENT TRADE NAME | TYPE | MANUFACTURER |
|---|---|---|
| Igepal CO-730 | Nonionic | GAF |
| Tergitol 08 | Anionic | Union Carbide |
| Miranol HS | Amphoteric | Miranol Chemical Co. |
| Amine C | Cationic | Ciba-Geigy |
| Avirol 100-E | Anionic | Standard Chemical Products, Inc. |

While the addition agents of the present invention are effective in many aqueous acid zinc plating bath formulations, the use of any of the basic baths described in the following examples have been found to give desirable results. Of course, it will be understood that the following examples are merely illustrations and the invention is not limited thereto.

EXAMPLE A

| BATH COMPOSITION | CONCENTRATION IN GRAMS/LITER |
|---|---|
| Zinc Chloride | 30 |
| Ammonium Chloride | 200 |
| Aminated polyepichlorohydrin wherein the amine is morpholine | 4 |
| Propylene oxide-ethylene oxide block copolymer prepared by the sequential addition of propylene oxide followed by ethylene oxide to a propylene glycol base, to a total molecular weight of 2800 with the polyoxyethylene portion at 40 percent by weight, (PLURONIC L64 manufactured by BASF-WYNADOTTE CORP.) | 3 |
| Benzylidene acetone | 0.1 |
| Avirol 100-E | 2 |
| pH=5.5 | |

EXAMPLE B

| BATH COMPOSITION | CONCENTRATION IN GRAMS/LITER |
|---|---|
| Zinc Sulfate | 40 |
| Ammonium Chloride | 180 |
| Linear aliphatic amine polymer derived from epichlorohydrin and diethylene triamine | 2 |
| Propylene oxide-ethylene block copolymer prepared by the sequential addition of ethylene oxide followed by propylene oxide to an ethylene glycol base, to a total molecular weight of 8500 with the polyoxyethylene portion at 80 percent by weight, (PLURONIC 17R8 manufactured by BASF-WYANDOTTE CORP.) | 4 |
| Benzylidene acetone | 0.2 |
| Avirol 100-E | 2 |
| pH=5.8 | |

EXAMPLE C

| BATH COMPOSITION | CONCENTRATION IN GRAMS/LITER |
|---|---|
| Zinc Chloride | 35 |
| Ammonium Chloride | 180 |
| Polyethylenimine (molecular weight = 600) | 4 |
| Propylene oxide-ethylene oxide block copolymer prepared by the sequential addition of propylene oxide followed by ethylene oxide to an ethylene diamine base, to a total molecular weight of 3000 with the polyoxyethylene portion at 40 percent by weight, (TETRONIC 504 manufactured by BASF-WYANDOTTE CORP.) | 4 |
| Benzylidene acetone | 0.01 |
| pH=5.0 | |

All testing was done in a conventional 267 ml. Hull cell using steel cathode panels and a zinc anode. Three ampere panels were run for five minutes at temperatures ranging from 70° F to 105° F with mechanical agitation. The test results from baths of Examples A, B, and C, along with comparative compositions are given in TABLE VI.

TABLE VI

| BATH COMPOSITION | PLATING TEST RESULTS |
|---|---|
| Bath of Example A | Extremely bright from about 0 to well over 150 amps./sq. ft. with bright but streaked deposit over 150 amps./sq. ft. |
| Bath of Example B | Very bright from 0 to about 175 amps./sq. ft. |
| Bath of Example C | Very bright from 0 to well over 175 amps./sq. ft. |
| Bath of Example A, but without the block copolymer | Very dark, irregular plate from about 0 to 85 amps./sq. ft. with many random areas of no plate. |
| Bath of Example B, but without the block copolymer | Very dark, irregular plate from about 0 to 80 amps./sq. ft. with many random areas of no plate. |
| Bath of Example C, but without the block copolymer | Very dark, irregular plate from about 0 to 80 amps./sq. ft. with many random areas of no plate. |
| Bath of Example A, but without the animated polyepichlorohydrin | Semibright from 0 to about 45 amps./sq. ft. and dark, spongy deposits above 45 amps./sq. ft. |
| Bath of Example B, but without the linear aliphatic amine polymer | Semibright from about 5 to about 40 amps./sq. ft. with dark, spongy deposits above 40 amps./sq. ft. |
| Bath of Example C, but without the polyethylenimine | Semibright, cloudy deposit from 0 to about 40 amps./sq. ft. with dark spongy deposits above 40 amps./sq. ft. |

Thus, it can be readily seen that the brightener additive composition of the present invention gave very bright to extremely bright plating test results. When either the block copolymer or the polymeric amine was utilized by itself, only semibright to very dark deposits were obtained. Hence, an unexpected result in the plating ability of the additive combination has been achieved.

The following examples were made substituting potassium chloride and sodium chloride for the normally utilized ammonium chloride as well as a small amount of the complexing agent, ethylene diamine.

EXAMPLES D & E

| BATH COMPOSITION | CONCENTRATION IN GRAMS/LITER EXAMPLE D | EXAMPLE E |
|---|---|---|
| Zinc chloride | 100 | 100 |
| Potassium chloride | 200 | — |
| Sodium chloride | — | 200 |
| Ethylene diamine | 1 | 1 |
| Propylene oxide-ethylene oxide block copolymer prepared by the sequential addition of propylene oxide followed by ethylene oxide to a propylene glycol base, to a total molecular weight of 2800 with the polyoxyethylene portion at 40 percent by weight, (PLURONIC L64 manufactured by BASF-WYANDOTTE CORP.) | 4 | 4 |
| Linear aliphatic amine polymer derived from epichlorohydrin and diethylene triamine | 2 | 2 |
| Benzylidene acetone | 0.2 | 0.2 |
| Miranol HS | 4 | 4 |
| | pH=5.8 | |

A plating bath having the formulation of Examples D & E were tested using the same conditions set forth above. Very bright deposits of zinc were obtained from about 0 to about 120 amps. per square foot.

Having thus described the invention in full, clear, concise, and exact terms as to enable any person skilled in the art to which it pertains to make and use the same and having set forth the best mode contemplated for carrying out this invention in accordance with the patent statutes, it will be apparent to those skilled in the art that equivalents or modifications of the above specifically described embodiments of the invention may be made without departing from the spirit of the invention disclosed and described herein; the scope of the invention being limited by the scope of the attached claims.

What is claimed is:

1. A zinc brightener additive comprising, from about 1 percent to about 99 percent by weight of a polymeric amine selected from the class consisting of;

a linear aliphatic amine polymer prepared by reacting from about 50 percent to about 200 percent of a stoichiometric amount of an epihalohydrin selected from the class consisting of epichlorohydrin and epibromohydrin with a linear aliphatic polyamine selected from the class consisting of a compound having at least two primary amine groups, two secondary amine groups, one primary and one secondary amine group, said amine groups separated by two through six methylene groups or alkyl substituted methylene groups, an aminated polyepichlorohydrin prepared by reacting polyepichlorohydrin with an amine selected from the group consisting of secondary aliphatic amines and secondary alicyclic amines at a temperature of from about 110° C to about 170° C, the amount of said amines is such so that between 50 percent to 100 percent of the chloro groups in said polyepichlorohydrin is reacted, a polyethylenimine having the repeating unit:

$$\left(\overset{\overset{R}{|}}{N}-CH_2-CH_2\right)_y$$

where R is hydrogen, methyl, ethyl, propyl, isopropyl, hydroxyethyl, 2-hydroxypropyl, 3-hydroxypropyl, 2-aminoethyl, 2-aminopropyl, and 3-aminopropyl, and $y$ is about 10 to about 100, and combinations thereof, and including from about 99 percent to about 1 percent by weight of a propylene oxide-ethylene oxide block copolymer having a molecular weight of more than 500, said block copolymer prepared by the sequential addition of propylene oxide and ethylene oxide, in either order, to a residue of any organic compound containing a plurality of active hydrogen atoms.

2. A zinc brightener additive according to claim 1, wherein said linear aliphatic amine polymer is prepared by reacting at a temperature of from about 110° F to about 220° F, said secondary aliphatic amines and said secondary alicyclic amines of said aminated polyepichlorohydrin contains from 2 to about 6 carbon atoms and said block copolymer residue is selected from the class consisting of ethylene glycol, propylene glycol, a primary amine compound, and a secondary amine compound.

3. A zinc brightener additive according to claim 2, including from 1 to about 20 percent by weight of a compound selected from the class consisting of aromatic aldehydes, aromatic ketones, and combinations thereof.

4. A zinc brightener additive according to claim 3, wherein said aromatic aldehydes, said aromatic ketones, and combinations thereof, are selected from the group consisting of benzylidene acetone, vanillan, heliotropin, anisaldehyde, veratraldehyde, acetophenone, 1-acetonaphthone, 2-acetonaphthone, cinnamic aldehyde, 2-chlorobenzaldehyde, and 2,6-dichlorobenzaldehyde.

5. A zinc brightener additive according to claim 4, wherein said aromatic ketone is benzylidene acetone.

6. A zinc brightener additive according to claim 2, wherein said propylene oxide-ethylene oxide block copolymer has a molecular weight of about 900 to about 15,000, said block copolymer has a polyoxyethylene portion, said polyoxyethylene portion ranging from about 30 percent to about 90 percent by weight of said block copolymer.

7. A zinc brightener additive according to claim 6, wherein said amine residual base is selected from the class consisting of methylamine, ethylamine, propylamine, ethylene diamine, propylene diamine, ethanolamine, diethanolamine, dimethylamine, diethylamine, dipropylamine, dipropanolamine, diisopropanolamine, isopropylamine, diisopropylamine, diethylene triamine, triethylene tetramine, tetraethylene pentamine, and pentaethylene hexamine.

8. A zinc brightener additive according to claim 7, including from 1 to about 20 percent by weight of a compound selected from the class consisting of aromatic aldehydes, aromatic ketones, and combinations thereof.

9. A zinc brightener additive according to claim 8, wherein said aromatic aldehydes and said aromatic ketones are selected from the group consisting of benzylidene acetone, vanillan, heliotropin, anisaldehyde, veratraldehyde, acetophenone, 1-acetonaphthone, 2-acetonaphthone, cinnamic aldehyde, 2-chlorobenzaldehyde, and 2,6-dichlorobenzaldehyde.

10. A zinc brightener additive according to claim 9, wherein said aromatic ketone is benzylidene acetone.

11. A zinc brightener additive according to claim 7, wherein said amine of said aminated polyepichlorohydrin is selected from the class consisting of dimethylamine, diethylamine, dipropylamine, diisopropylamine, methyl ethylamine, methyl propylamine, methyl isopropylamine, ethyl isopropylamine, N-methyl ethanolamine, N-methyl propanolamine, N-ethyl isopropanolamine, N-propyl propanolamine, N-propyl isopropanolamine, N-isopropyl isopropanolamine, diethanolamine, dipropanolamine, diisopropanolamine, morpholine, and piperidine.

12. A zinc brightener additive according to claim 11, wherein said linear aliphatic polyamine of said linear aliphatic amine polymer is selected from the class consisting of ethylene diamine, propylene diamine, diethylene triamine, triethylene tetramine, tetraethylene pentamine, pentaethylene hexamine, and N-(2-aminoethyl)-1,3-propanediamine.

13. A zinc brightener additive according to claim 12, including from 1 to about 20 percent by weight of a compound selected from the class consisting of aromatic aldehydes, aromatic ketones, and combinations thereof, said aromatic aldehydes and said aromatic ketones are selected from the class consisting of benzylidene acetone, vanillan, heliotropin, anisaldehyde, veratraldehyde, acetophenone, 1-acetonaphthone, 2-acetonaphthone, cinnamic aldehyde, 2-chlorobenzaldehyde, and 2,6-dichlorobenzaldehyde.

14. A zinc brightener additive according to claim 13, wherein said aromatic ketone is benzylidene acetone.

15. An aqueous acid zinc eletroplating bath for producing a bright electrodeposition of zinc, containing zinc ions, comprising;

having dissolved therein from about 0.5 to about 10 grams/liter of a polymeric amine selected from the class consisting of, a linear aliphatic amine polymer prepared by reacting from about 50 percent to about 200 percent of a stoichiometric amount of an epihalohydrin selected from the class consisting of epichlorohydrin and epibromohydrin with a linear aliphatic polyamine selected from the class consisting of a compound having at least two primary amine groups, two secondary amine groups, one primary and one secondary amine group, said amine groups separated by two through six methylene groups or alkyl substituted methylene groups, an aminated polyepichlorohydrin prepared by reacting polyepichlorohydrin with an amine selected from the group consisting of secondary aliphatic amines and secondary alicyclic amines at a temperature of from about 110° C to about 170° C, the amount of said amines is such so that between 50 percent to 100 percent of the chloro groups in said polyepichlorohydrin is reacted, a polyethylenimine having the repeating unit:

$$\left(\overset{R}{\overset{|}{N}}-CH_2-CH_2\right)_y$$

where R is hydrogen, methyl, ethyl, propyl, isopropyl, hydroxyethyl, 2-hydroxypropyl, 3-hydroxypropyl, 2-aminoethyl, 2-aminopropyl, and 3-aminopropyl, and $y$ is about 10 to about 100, and combinations thereof, and including from about 1 to about 10 grams/liter of a propylene oxide-ethylene oxide block copolymer having a molecular weight of more than 500, said copolymer prepared by sequential addition of propylene oxide and ethylene oxide, in either order, to a residue of any organic compound containing a plurality of active hydrogen atoms.

16. A bath according to claim 15, wherein said linear aliphatic amine polymer is prepared by reacting at a temperature of from about 110° F to about 220° F, said secondary aliphatic amines and said secondary alicyclic amines of said aminated polyepichlorohydrin contains from 2 to about 6 carbon atoms, and said block copolymer residue is selected from the class consisting of ethylene glycol, propylene glycol, a primary amine compound, and a secondary amine compound.

17. A bath according to claim 16, including from about 0.05 to about 0.05 grams/liter of a compound selected from a class consisting of aromatic aldehydes, aromatic ketones, and combinations thereof.

18. A bath according to claim 17, wherein said aromatic aldehydes and said aromatic ketones are selected from a class consisting of benzylidene acetone, vanillan, heliotropin, anisaldehyde, veratraldehyde, acetophenone, 1-acetonaphthone, 2-acetonaphthone, cinnamic aldehyde, 2-chlorobenzaldehyde, and 2,6-dichlorobenzaldehyde.

19. A bath according to claim 18, wherein said aromatic ketone is benzylidene acetone.

20. A bath according to claim 17, including ammonium chloride.

21. A bath according to claim 17, including a compound selected from the class consisting of potassium chloride, sodium chloride, and combinations thereof.

22. A bath according to claim 21, including ethylene diamine.

23. A bath according to claim 16, wherein said propylene oxide-ethylene oxide block copolymer has a molecular weight of about 900 to about 15,000, said block copolymer contains a polyoxyethylene portion, and said polyoxyethylene portion contains from about 30 percent to about 90 percent by weight of said block copolymer.

24. A bath according to claim 23, wherein said residual amine base is selected from the class consisting of methylamine, ethylamine, propylamine, ethylene diamine, propylene diamine, ethanolamine, diethanolamine, dimethylamine, diethylamine, dipropylamine, dipropanolamine, diisopropanolamine, isopropylamine, diisopropylamine, diethylene triamine, triethylene tetramine, tetraethylene pentamine, and pentaethylene hexamine.

25. A bath according to claim 24, including from about 0.05 to about 0.5 grams/liter of a compound selected from the class consisting of aromatic aldehydes, aromatic ketones, and combinations thereof.

26. A bath according to claim 25, wherein said aromatic aldehydes and said aromatic ketones are selected from the class consisting of benzylidene acetone, vanillan, heliotropin, anisaldehyde, veratraldehyde, acetophenone, 1-acetonaphthone, 2-acetonaphthone, cinnamic aldehyde, 2-chlorobenzaldehyde, and 2,6-dichlorobenzaldehyde.

27. A bath according to claim 26, wherein said aromatic ketone is benzylidene acetone.

28. A bath according to claim 25, including ammonium chloride.

29. A bath according to claim 24, wherein said amine of said aminated polyepichlorohydrin is selected from the class consisting of dimethylamine, diethylamine, dipropylamine, diisopropylamine, methyl ethylamine, methyl propylamine, methyl isopropylamine, ethyl isopropylamine, N-methyl ethanolamine, N-methyl propanolamine, N-ethyl isopropanolamine, N-propyl propanolamine, N-propyl isopropanolamine, N-isopropyl isopropanolamine, diethanolamine, dipropanolamine, diisopropanolamine, morpholine, and piperidine.

30. A bath according to claim 29, wherein said linear aliphatic polyamine of said linear aliphatic amine polymer is selected from the class consisting of ethylene diamine, propylene diamine, diethylene triamine, triethylene tetramine, tetraethylene pentamine, pentaethylene hexamine, and N-(2-aminoethyl)-1,3-propanediamine.

31. A bath according to claim 30, including from about 0.05 to about 0.5 grams/liter of a compound selected from the class consisting of benzylidene acetone, vanillan, heliotropin, anisaldehyde, veratraldehyde, acetophenone, 1-acetonaphthone, 2-acetonaphthone, cinnamic aldehyde, 2-chlorobenzaldehyde, and 2,6-dichlorobenzaldehyde.

32. A bath according to claim 31, wherein said aromatic ketone is benzylidene acetone.

33. A bath according to claim 31, including ammonium chloride.

34. A bath according to claim 23, including from about 1 to about 10 grams/liter of a compound selected from the group consisting of a nonionic wetting agent, a cationic wetting agent, an anionic wetting agent, an amphoteric wetting agent, and combinations thereof.

35. A bath according to claim 34, including ammonium chloride.

* * * * *